US005487653A

United States Patent [19]

Lee

[11] Patent Number: 5,487,653

[45] Date of Patent: Jan. 30, 1996

[54] AXIAL LEAKAGE RESISTANT APPARATUS OF SCROLL-TYPE COMPRESSOR

[75] Inventor: Byung C. Lee, Seoul, Rep. of Korea

[73] Assignee: Goldstar Co. Ltd., Seoul, Rep. of Korea

[21] Appl. No.: 288,794

[22] Filed: Aug. 12, 1994

[30] Foreign Application Priority Data

Aug. 17, 1993 [KR] Rep. of Korea ..... 1993-15922

[51] Int. Cl.[6] ..... F04C 18/04

[52] U.S. Cl. ..... 418/14; 418/55.4; 418/55.5; 418/57

[58] Field of Search ..... 418/14, 55.5, 57, 418/55.4

[56] References Cited

U.S. PATENT DOCUMENTS 5,192,202 3/1993 Lee ..... 418/55.5

FOREIGN PATENT DOCUMENTS

| | | | |
|---|---|---|---|
| 59-29790 | 2/1984 | Japan | 418/55.5 |
| 2149783 | 6/1990 | Japan | 418/55.5 |
| 3237283 | 10/1991 | Japan | 418/55.5 |
| 5-26002 | 2/1993 | Japan | 418/55.5 |

*Primary Examiner*—John J. Vrablik
*Attorney, Agent, or Firm*—Spencer & Frank

[57] ABSTRACT

This invention relates to the prevention of leakage caused by the gap between the tip member of a scroll wrap and the end plate of the other scroll, and the axial leakage apparatus of a scroll compressor for reducing the power loss caused due to the use of the compressed refrigerant gas at the time of the prevention of leakage, which is accomplished by the axial leakage resistant apparatus of a scroll compressor including the pressurization member to pressurize the fixed scroll toward the lower shaft of the crankshaft with a part of the refrigerant gas of high pressure exhaled into the exhalation chamber and the control member to control the compression interval of the fixed scroll by the pressurization of the above pressurization member.

4 Claims, 3 Drawing Sheets

AXIAL LEAKAGE RESISTANT APPARATUS OF SCROLL-TYPE COMPRESSOR

FIELD THE INVENTION

This invention relates to the axial leakage resistant apparatus of a scroll-type compressor, and more particularly to the axial leakage resistant apparatus of a scroll-type compressor adapted for preventing leakage caused by the gap between a tip member of the scroll wrap and an end plate of the other scroll.

BACKGROUND OF THE INVENTION

Generally speaking, a scroll apparatus used for a refrigeration apparatus comprises two spiral scroll wraps mounted on a separate end plate to define a scroll member. The two scroll wraps the above are intermitted together with one of them being rotationally displaced 180 degrees from the other.

FIG. 1 of the attached drawing figures is a vertical sectional view of the conventional scroll-type compressor, which comprises stator 1 and rotor 2 to generate rotation power, crankshaft 3 heat thrust into the above rotor 2, rotation pin 4 with the center eccentric from that of the above crankshaft 3, rotation bush 5 surrounding the outer circumference of the above rotation pin 4, orbiting scroll 7 installed on the outer circumferential surface of the above rotation bush 5 and compressing the refrigerant inhaled simultaneously at two parts of the scroll circumference through inhalation duct 6 by way of the orbital motion in accordance with the rotation of the above crankshaft 3, fixed scroll or non-orbiting scroll 8 fixed at main frame 17 in opposition to the top plate of the above orbiting scroll 17, compression chamber 9 to compress the refrigerant gas inside the above fixed scroll 8, exhalation outlet 10 exhaling the refrigerant of high pressure coming out of the above compression chamber 9, exhalation chamber 11 storing the above exhaled refrigerant temporarily, and circular cylindrical steel shell 12 containing all of the above mention components inside.

And between the above fixed scroll 8 and top diaphragm 18, pressure distribution chamber 14 is located, which pushes fixed scroll 8 toward orbiting scroll 7 by distributing the pressure of refrigerant gas drawn in from compression chamber through pressure distribution bore 13.

The indescribed code 15 of the above drawing figure is a leaf spring to fix the above fixed scroll 8 at main frame 17 by connecting with bolt 18.

The description of the movements of a scroll-type compressor with the above configuration and the problems thereof is as follows:

The refrigerant gas inhaled through inhalation duct 6 is inhaled simultaneously at two parts of the scroll circumference in accordance with the orbital motion of orbiting scroll 7.

The two symmetrical crescent-shaped pockets of fluid formed in accordance with inhaling actions of refrigerant by the above orbiting scroll 7 are compressed and move toward the center with the reduction of volume.

And the pocket figures compressed in the center are intermixed and exhaled through exhalation outlet 10.

The process from inhalation to exhalation is usually completed if crankshaft 3 rotates around 2–3 times.

However, at the time of inhalation during the above process, the refrigerant gas is leaked from a pocket of high pressure to a pocket of low pressure through two kinds of course. One is leakage caused by the gap between tip members 19 and 20 of fixed scroll and orbiting scroll wraps and an end plate of the other scroll, which is referred to as axial leakage, and the other is leakage caused by the gap between wraps of both scrolls 7 and 8, which is referred to as radial direction leakage.

In consideration of the quantity of entire leakage, the axial leakage is much greater than the radial direction leakage and its disposal is necessarily required.

The conventional technique to prevent the axial leakage of a scroll compressor like this is illustrated in FIG. 22. As shown in the drawing figure, it is configured that fixed scroll 8 and main frame 17 are assembled by connecting with bolt 16 through leaf spring 15 and pressure distribution chamber 14 with a regular cross-sectional area is located at the rear plate of the above fixed scroll 8.

While the compression process proceeds in the above configuration, the compressed gas with pressure of F1 is sent to pressure distribution chamber 14 through pressure distribution bore 13. The compressed gas distributed with the regular pressure in pressure distribution chamber 14 puts pressure of F2 on fixed scroll 8.

As fixed scroll 8 moves downward by distributed pressure F2 put on the above fixed scroll 8, this minimizes the gap between tip members 19 and 20 of the scroll wrap and an end plate of the other scroll, which minimizes the axial leakage caused in this gap.

A scroll-type compressor to prevent the axial leakage like this is mentioned in the precedent technology such as U.S. Pat. Nos. 3,874,827 and 4,877,382.

But the architecture to prevent the axial leakage by using the pressure of pressure distribution chamber 14 in this manner has a problem that the power loss is caused, because it is designed to extract and use a part of the compressed gas. This fact can be found from volume versus pressure change graph of FIG. 3. That is, as illustrated in the graph, it shows that the power loss has been caused as much as the part obliquely lined due to the linkage of compression chamber 9 and pressure distribution bore 13 in a section (S) marked on a horizontal axis, in the process that the volume is expanded and compressed.

SUMMARY OF THE INVENTION

This invention intends to provide the axial leakage resistant apparatus of a scroll compressor for a purpose to solve these conventional problems.

Such a purpose and others are achieved by the axial leakage resistant apparatus of a scroll compressor including a pressurization member for pressurizing the fixed scroll by using a part of the refrigerant gas of high pressure in the exhalation chamber, and a supporting member for supporting the fixed scroll by buffing the load of the fixed scroll in accordance with the pressurization of the pressurization member.

DETAILED DESCRIPTION OF THE INVENTION

Figure 1:
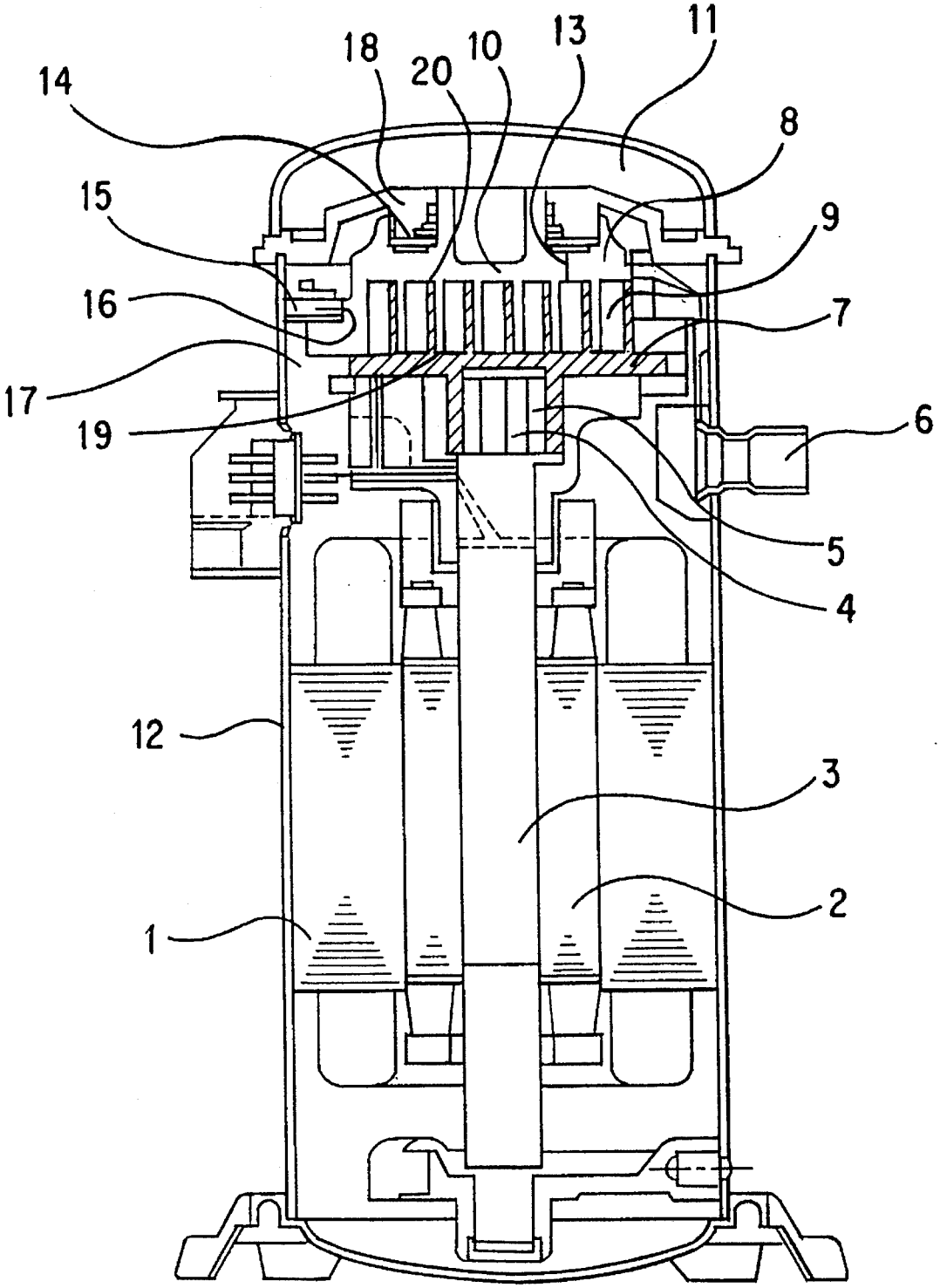
FIG. 1 (PRIOR ART)
FIG. 1 is a cross-sectional view of a conventional compressor.
Figure 2:
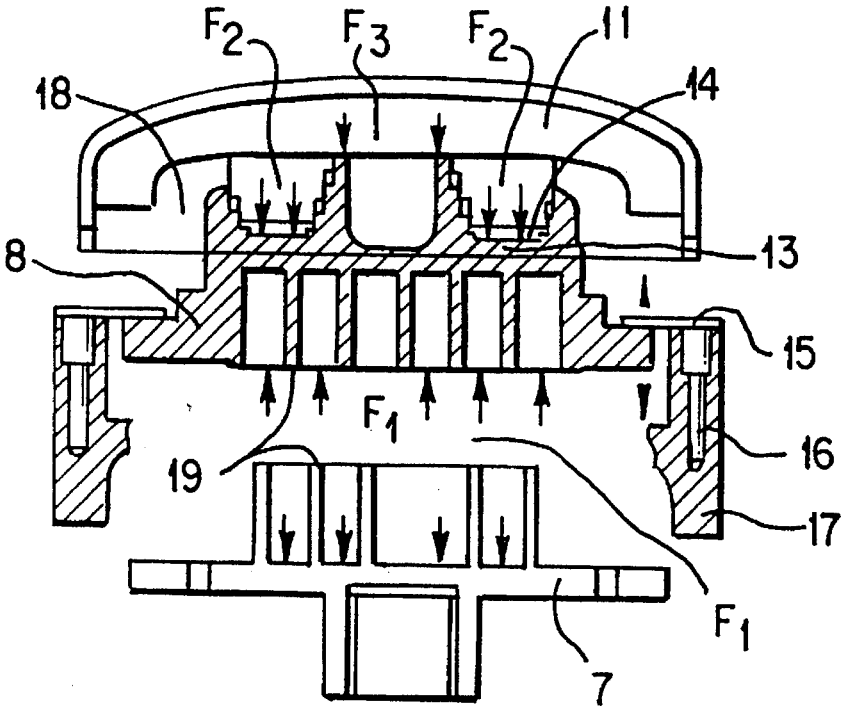
FIG. 2 (PRIOR ART)
FIG. 2 is a cross-sectional view of the axial hermetic apparatus of a conventional scroll compressor.
Figure 3:
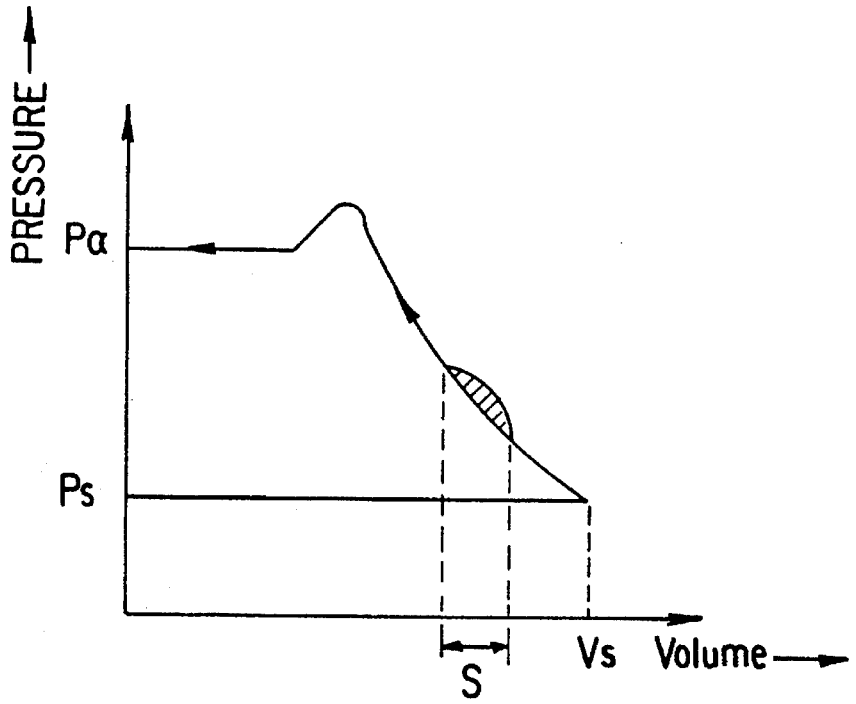
FIG. 3 (PRIOR ART)
FIG. 3 is a graph showing the change of volume versus pressure in accordance with the compression of a conventional scroll compressor.
Figure 4:
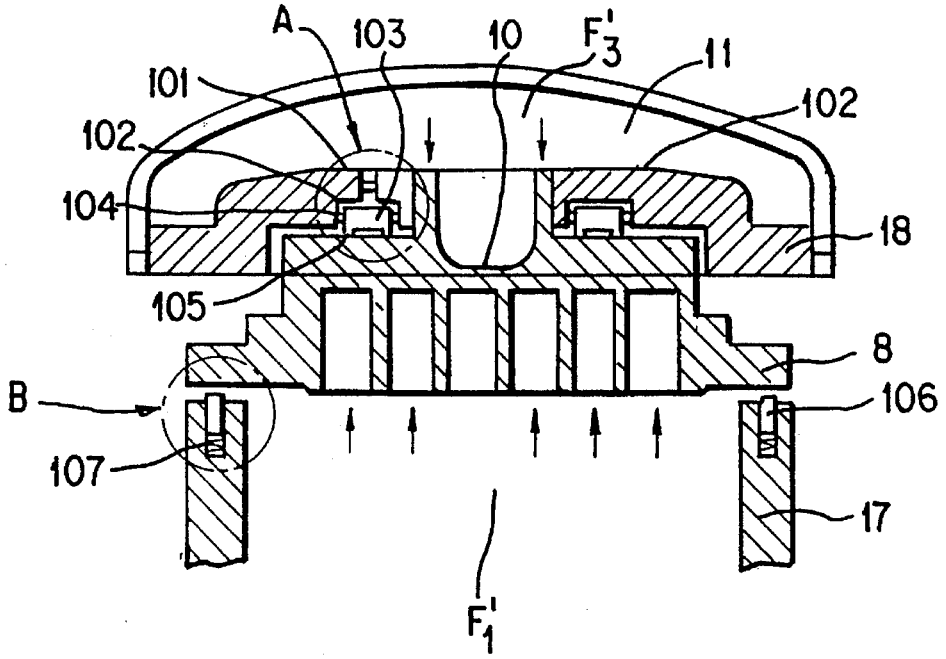
FIG. 4 is a cross-sectional view of this invention, the axial leakage resistant apparatus of a scroll compressor.
Figure 5A:
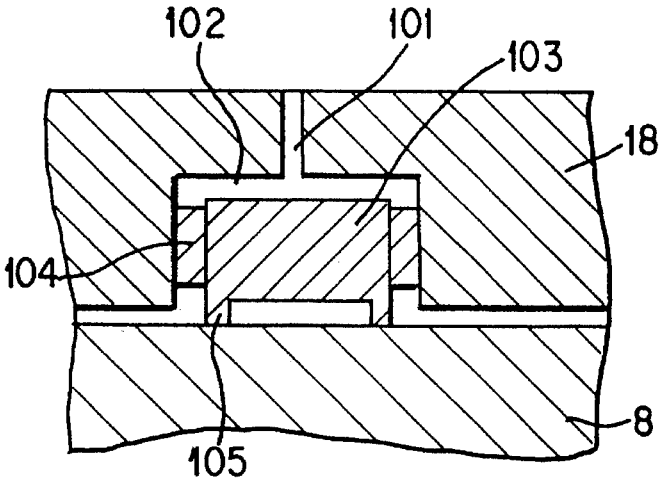
FIG. 5 is a magnified drawing of main parts illustrated in FIG. 4; (I) is a magnified drawing of A part and (II) is a magnified drawing of B part.
Figure 5B:
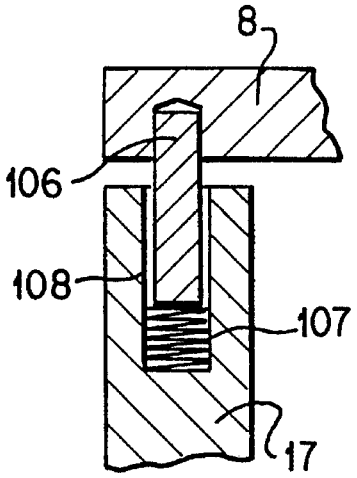

FIG. 4 and FIG. 5 of the attached drawing figures are the cross-sectional views of this invention, the axial leakage resistant apparatus of a scroll-type compressor, which comprises a pressurization member to pressurize fixed scroll 8 by using the refrigerant gas of high pressure in exhalation chamber 11 and a supporting member to support the above fixed scroll 8 by buffing the load of fixed scroll 8 in accordance with the pressurization of the above pressurization member.

The above pressurization member comprises high pressure bore 101 for inducing the refrigerant gas of high pressure in exhalation chamber 11, high pressure chamber 102 for storing the gas of high pressure flowed in through the above high pressure bore 101, pressurization subsidiary substance 103 for pressurizing fixed scroll 8 directly with the gas of high pressure filling the above high pressure chamber 102 up and a blocking member formed at a side plate of the above pressurization subsidiary substance 103 for blocking the leakage of the gas of high pressure toward a inhalation member.

And the above supporting member comprises pin 106 for assembling fixed scroll 8 in main frame 17, compression spring 107 for buffing the load of main frame 17 transferred through the above Pin 106 with elastic force, and insertion hole 108 through which the above pin 106 and compression spring 107 are inserted.

The above blocking member forming the above pressurization member comprises hermetic subsidiary substance 104 for preventing the leakage from exhalation chamber 11 to the inhalation side and protuberant part of pressurization member substance 105 for preventing the leakage from the exhalation chamber to the inhalation side once more successively to the above hermetic subsidiary substance 104.

For the configuration of this invention, a scroll compressor, the components other than the axial leakage resistant apparatus mentioned the above are configured in the same manner as the conventional case.

The detailed description of this invention with a configuration as above and the effect thereof is as follows:

First, the above main frame 17 and fixed scroll 8 are linked to each other by using a screw after spring 107 and pin 19 are mounted into insertion hole 108 of main frame 17.

Then, in a state that compression spring 107 and pin 106 are inserted consecutively into insertion hole 108 of main frame 17 to reduce the load of initialization between the above main frame 17 and fixed scroll 8, main frame 17 and fixed scroll 8 are assembled by leaving the gap of a certain interval between scroll tip members 19 and 20 and an end plate of the scroll.

If a compressor starts in this state, a part of the refrigerant gas compressed and exhaled into the exhalation chamber through exhalation bore 10 is sent to high pressure bore 101. The gas sent to the above high pressure bore 101 fills high pressure chamber 102 up, and accordingly the exhaled gas becomes to put pressure on pressurization subsidiary substance 103.

In accordance with the pressure of the above high pressure chamber 102, the above pressurization subsidiary substance 103 prevents the axial leakage by pushing fixed scroll 8 downward and minimizing the gap between scroll tip members 19 and 20 and an end plate of the scroll to the appropriate interval.

On the other hand, the leakage from the inhalation side to exhalation chamber 11 is blocked by protuberant part of pressurization subsidiary substance 105 pushed toward the side of fixed scroll 8.

As described above, this invention has an effect to reduce the power loss by using the refrigerant gas exhaled at the time of sealing the axial scroll wrap hermetic, in comparison with the conventional technology to prevent the axial leakage by sending a part of the compressed gas to the pressure distribution chamber.

Besides, it also has a remarkably enhanced effect from the viewpoint of balance, because no moment is generated due to the unbalance of right and left compression pockets.

What is claimed is:

1. An axial leakage resistant apparatus of a scroll compressor having an upper fixed scroll connected to a main frame, and a lower orbiting scroll, said apparatus comprising:

a pressurization means for pressurizing the fixed scroll by using a part of the refrigerant gas of high pressure in an exhalation chamber; said pressurization means include a high pressure bore interconnecting the exhalation chamber and a high pressure chamber for passing the high pressure refrigerant gas from said exhalation chamber to said high pressure chamber, and a pressurization element in said high pressure chamber for pressurizing said fixed scroll toward said orbiting scroll in response to said high pressure refrigerant in said high pressure chamber, and supporting means including pins fitted in holes in said fixed scroll and said main frame, and elastic members for supporting said fixed scroll through said pins by buffing said pins with elastic force.

2. An axial leakage resistant apparatus of a scroll compressor having an upper fixed scroll connected to a main frame, and a lower orbiting scroll, said apparatus comprising:

a pressurization means including:

an exhalation chamber above said fixed scroll, and a partition member separating an exhalation chamber and said fixed scroll, a high pressure chamber in said partition member for storing high pressure refrigerant gas, a high pressure bore interconnecting said exhalation chamber and said high pressure chamber for passing said high pressure refrigerant gas from said exhalation chamber to said high pressure chamber, and a pressurization element in said high pressure chamber for pressurizing said fixed scroll toward said orbiting scroll in response to said high pressure refrigerant in said high pressure chamber, said pressurization element having blocking means on the side walls thereof for preventing said high pressure refigerant gas from leaking therethrough; and means for supporting said fixed scroll on said main frame by buffing the load of said fixed scroll in response to pressurization of said pressurization means.

3. An axial leakage resistant apparatus as claimed in claim 2 wherein said supporting means includes a pins fitted in holes in said fixed scroll and said main frame, and elastic members for supporting said fixed scroll through said pins by buffing said pins with elastic force.

4. An axial leakage resistant apparatus as claim 2, wherein said blocking means includes an hermetic member for preventing the leakage of said refrigerant gas from the exhalation chamber to an inhalation side, and wherein said pressurization member includes a protuberant part abutting said fixed scroll.

* * * * *